US010913071B2

(12) United States Patent
Van Middendorp

(10) Patent No.: US 10,913,071 B2
(45) Date of Patent: Feb. 9, 2021

(54) SCALPER APPARATUS AND PROCESSING SYSTEM

(71) Applicant: Casey Van Middendorp, Harrisburg, SD (US)

(72) Inventor: Casey Van Middendorp, Harrisburg, SD (US)

(73) Assignee: Pearson Incorporated, Sioux Falls, SD (US)

( * ) Notice: Subject to any disclaimer, the term of this patent is extended or adjusted under 35 U.S.C. 154(b) by 468 days.

(21) Appl. No.: 15/225,916

(22) Filed: Aug. 2, 2016

(65) Prior Publication Data

US 2017/0259303 A1 Sep. 14, 2017

Related U.S. Application Data

(60) Provisional application No. 62/305,693, filed on Mar. 9, 2016.

(51) Int. Cl.
*B07B 1/52* (2006.01)
*B02C 23/08* (2006.01)
(Continued)

(52) U.S. Cl.
CPC ..... *B02C 4/286* (2013.01); *B02C 4/40* (2013.01); *B02C 23/02* (2013.01); *B02C 23/08* (2013.01); *B07B 1/46* (2013.01); *B07B 1/522* (2013.01)

(58) Field of Classification Search
CPC ..... B02C 4/286; B02C 4/40; B02C 23/02; B02C 23/08; B07B 1/52; Y10T 29/4561
(Continued)

(56) References Cited

U.S. PATENT DOCUMENTS 254,974 A 3/1882 Hollingsworth
417,836 A * 12/1889 Ponsar ..... A47J 43/22 209/358
(Continued)

FOREIGN PATENT DOCUMENTS

CN 207385669 5/2018
DE 102005055373 5/2007
(Continued)

OTHER PUBLICATIONS

Charles Stark and Julie Kalivoda, "Evaluating Particle Size of Feedstuffs", publication, Nov. 2016, 4 pages, K-State Research and Extension, Kansas State University Agricultural Experiment Station and Cooperative Extension Services, Manhattan, Kansas.

*Primary Examiner* — Teresa M Ekiert
*Assistant Examiner* — Jared O Brown
(74) *Attorney, Agent, or Firm* — Jeffrey A. Proehl; Woods, Fuller, Shultz & Smith, PC

(57) ABSTRACT

A scalper apparatus configured to divide a flow of material between filtered and unfiltered streams. The scalper apparatus may include a housing with an upper opening, a primary lower opening for outputting the filtered stream, and a secondary lower opening for outputting the unfiltered stream. The scalper apparatus may include a grate extending across the interior of the housing such that any material leaving the interior through the primary lower opening must pass through the grate while any material unable to pass through the grate is caused to move through the secondary lower opening. The scalper assembly may include a brush assembly with at least one brush movable across the grate, and a carrier assembly configured to carry the at least one brush across substantially an entire top of the grate.

1 Claim, 6 Drawing Sheets

(51) Int. Cl.

| | |
|---|---|
| ***B02C 4/40*** | (2006.01) |
| ***B02C 4/28*** | (2006.01) |
| ***B02C 23/02*** | (2006.01) |
| ***B07B 1/46*** | (2006.01) |

(58) Field of Classification Search
USPC ..... 241/81, 166, 224
See application file for complete search history.

(56) References Cited

U.S. PATENT DOCUMENTS

| | | | | |
|---|---|---|---|---|
| 454,950 | A | | 6/1891 | Sewell |
| 473,957 | A | * | 5/1892 | Pollock ..... D21D 5/026 209/273 |
| 621,744 | A | | 3/1899 | Bowden |
| 664,836 | A | | 1/1901 | Davidson |
| 738,166 | A | | 9/1903 | Davidson |
| 1,466,508 | A | | 8/1923 | Lake |
| 1,568,267 | A | | 1/1926 | Carter |
| 1,611,675 | A | | 12/1926 | Prestemon |
| 2,053,038 | A | | 9/1936 | MacKenzie |
| 2,118,010 | A | | 5/1938 | Hazle, Jr. |
| 3,226,041 | A | | 12/1965 | Graumann |
| 3,304,355 | A | | 2/1967 | Pobst, Jr. |
| 3,362,649 | A | | 1/1968 | Odden |
| 3,683,559 | A | | 8/1972 | Kalwaites |
| 3,752,315 | A | | 8/1973 | Hubach |
| 4,165,280 | A | * | 8/1979 | Holley ..... D01G 9/16 198/550.8 |
| 4,177,900 | A | | 12/1979 | Kluthe |
| 4,202,629 | A | | 5/1980 | Jakobs |
| 4,213,855 | A | | 7/1980 | Vonbennigsen-Mackiewicz |
| 4,361,476 | A | | 11/1982 | Brewer |
| 4,387,552 | A | | 6/1983 | Lancaster |
| 4,442,876 | A | | 4/1984 | Koike |
| 4,468,265 | A | | 8/1984 | MacLaughlin |
| 4,608,156 | A | | 8/1986 | Reddish, Jr. |
| 4,645,484 | A | | 2/1987 | Niske |
| 4,786,001 | A | | 11/1988 | Ephraim |
| 4,862,570 | A | | 9/1989 | Bald |
| 4,941,290 | A | | 7/1990 | Holyoke |
| 4,986,997 | A | | 1/1991 | Posner |
| 5,052,088 | A | | 10/1991 | Hagewood |
| 5,100,062 | A | | 3/1992 | Baltensperger |
| 5,115,984 | A | | 5/1992 | Satake |
| 5,192,028 | A | | 3/1993 | Curran |
| 5,201,470 | A | | 4/1993 | Baltensperger |
| 5,251,144 | A | | 10/1993 | Ramamurthi |
| 5,315,789 | A | | 5/1994 | Takashi |
| 5,366,167 | A | * | 11/1994 | McCarthy ..... B02C 4/286 209/675 |
| 5,392,998 | A | | 2/1995 | Suessegger |
| 5,501,629 | A | | 3/1996 | Kawana |
| 5,523,701 | A | | 6/1996 | Smith |
| 5,533,371 | A | | 7/1996 | Frischknecht |
| 5,717,209 | A | | 2/1998 | Bigman |
| 6,176,683 | B1 | | 1/2001 | Yang |
| 6,199,777 | B1 | | 3/2001 | Satake |
| 6,293,478 | B1 | | 9/2001 | Livieri |
| 6,365,416 | B1 | | 4/2002 | Elsohly |
| 6,372,281 | B1 | | 4/2002 | Metzger |
| 6,443,376 | B1 | | 9/2002 | Huang |
| 6,517,016 | B1 | | 2/2003 | Feige |
| 6,589,598 | B2 | | 7/2003 | Ochiai |
| 6,730,519 | B2 | | 5/2004 | Elsohly |
| 6,990,431 | B2 | | 1/2006 | Beaudoin |
| 7,006,953 | B2 | | 2/2006 | Takemura |
| 7,083,544 | B2 | | 8/2006 | Goransson |
| 7,170,251 | B2 | | 1/2007 | Huang |
| 7,183,735 | B2 | | 2/2007 | Heinemann |
| 7,206,719 | B2 | | 4/2007 | Lindsay |
| 7,381,017 | B2 | | 6/2008 | Wang |
| 7,419,694 | B2 | | 9/2008 | Korolchuk |
| 7,425,344 | B2 | | 9/2008 | Korolchuk |
| 7,540,697 | B2 | | 1/2009 | Wang |
| 7,568,641 | B2 | | 8/2009 | Dreimann |
| 7,592,468 | B2 | | 9/2009 | Goodwin |
| 7,756,678 | B2 | | 7/2010 | Bonissone |
| 7,832,241 | B2 | | 11/2010 | Mantovan |
| 8,144,005 | B2 | | 3/2012 | Hu |
| 8,206,061 | B1 | | 6/2012 | Hansen |
| 8,211,341 | B2 | | 7/2012 | Lustiger |
| 8,343,553 | B2 | | 1/2013 | Hospodor |
| 8,485,052 | B2 | | 7/2013 | Gebhart |
| 8,690,087 | B2 | | 4/2014 | Holl |
| 8,734,143 | B2 | | 5/2014 | Morris |
| 8,842,267 | B2 | | 9/2014 | Heine |
| 9,066,910 | B2 | | 6/2015 | Rosenblatt |
| 9,104,650 | B2 | | 8/2015 | Hosek |
| 9,604,226 | B2 | | 3/2017 | Storm |
| 9,649,349 | B1 | | 5/2017 | Tucker |
| 9,651,467 | B2 | | 5/2017 | Deguchi |
| 9,694,040 | B2 | | 7/2017 | Scialdone |
| 9,788,770 | B1 | | 10/2017 | Belthangady |
| 9,795,338 | B2 | | 10/2017 | Kang |
| 9,797,822 | B2 | | 10/2017 | Little, III |
| 9,801,956 | B2 | | 10/2017 | Kularatne |
| 9,803,063 | B2 | | 10/2017 | Reddy |
| 9,804,092 | B2 | | 10/2017 | Zeng |
| 9,808,538 | B2 | | 11/2017 | Kularatne |
| 9,919,315 | B2 | | 3/2018 | Pearson |
| 9,959,514 | B2 | | 5/2018 | Phan |
| 9,974,821 | B2 | | 5/2018 | Kennedy |
| 2002/0022899 | A1 | | 2/2002 | Dehy |
| 2002/0168911 | A1 | | 11/2002 | Tonner |
| 2003/0017426 | A1 | | 1/2003 | Schmidt |
| 2004/0096585 | A1 | | 5/2004 | Bonnebat |
| 2006/0073258 | A1 | | 4/2006 | Korolchuk |
| 2006/0231021 | A1 | | 10/2006 | Friske |
| 2007/0170291 | A1 | | 7/2007 | Naganawa |
| 2007/0294121 | A1 | | 12/2007 | Galt |
| 2008/0063330 | A1 | | 3/2008 | Orlowski |
| 2008/0167483 | A1 | | 7/2008 | Whittle |
| 2008/0203956 | A1 | | 8/2008 | Cohen |
| 2008/0275660 | A1 | | 11/2008 | Bhateja |
| 2009/0093191 | A1 | | 4/2009 | Glide |
| 2009/0295561 | A1 | | 12/2009 | Hu |
| 2010/0030926 | A1 | | 2/2010 | Boussy |
| 2010/0059609 | A1 | | 3/2010 | Teeter |
| 2010/0127217 | A1 | | 5/2010 | Lightowlers |
| 2011/0067374 | A1 | | 3/2011 | James |
| 2011/0276828 | A1 | | 11/2011 | Tamaki |
| 2012/0005017 | A1 | | 1/2012 | Lowden |
| 2012/0244266 | A1 | | 9/2012 | Ku |
| 2013/0087644 | A1 | | 4/2013 | Ephraim |
| 2013/0271110 | A1 | | 10/2013 | Yamanaka |
| 2013/0301375 | A1 | | 11/2013 | Stephan |
| 2014/0014748 | A1 | | 1/2014 | Zeeck |
| 2014/0048459 | A1 | | 2/2014 | Hufford |
| 2014/0145018 | A1 | | 5/2014 | Niklewski |
| 2014/0245799 | A1 | | 9/2014 | Kim |
| 2014/0299688 | A1 | | 10/2014 | Carbonini |
| 2015/0129698 | A1 | | 5/2015 | Olson |
| 2015/0211971 | A1 | | 7/2015 | Little, III |
| 2015/0300800 | A1 | | 10/2015 | Van Valkenburgh |
| 2015/0324759 | A1 | | 11/2015 | Bansal |
| 2015/0346717 | A1 | | 12/2015 | Hosek |
| 2017/0080466 | A1 | | 3/2017 | Godwin |
| 2017/0131194 | A1 | | 5/2017 | Little, III |
| 2017/0333257 | A1 | | 11/2017 | Schmitz |

FOREIGN PATENT DOCUMENTS

| | | |
|---|---|---|
| EP | 1195668 | 9/2002 |
| WO | 2005119089 | 12/2005 |
| WO | 2007066847 | 6/2007 |
| WO | 2010082322 | 7/2010 |
| WO | 2017051398 | 3/2017 |

* cited by examiner

SCALPER APPARATUS AND PROCESSING SYSTEM

REFERENCE TO RELATED APPLICATIONS

This application claims the benefit of U.S. Provisional Patent Application No. 62/305,693 filed Mar. 9, 2016, which is hereby incorporated by reference in its entirety.

BACKGROUND

Field

The present disclosure relates to scalper apparatus and more particularly pertains to a new scalper apparatus and processing system for removing foreign material from a stream of material prior to further processing, such as grinding of the filtered material.

SUMMARY

In one aspect, the present disclosure relates to a material processing system that may comprise a scalper apparatus configured to divide a flow of material between a filtered stream and an unfiltered stream, with the scalper apparatus having an inlet for receiving unprocessed material and an outlet for outputting processed material. The scalper apparatus may comprise a housing having an interior, an upper opening defining the inlet of the scalper apparatus, a primary lower opening for outputting the filtered stream of material, and a secondary lower opening for outputting the unfiltered stream of material. The scalper apparatus may also include a grate extending across the interior of the housing such that any material leaving the interior through the primary lower opening must pass through the grate while any material unable to pass through the grate is caused to move through the secondary lower opening. The scalper assembly may further include a brush assembly configured to move material entering the apparatus along the grate from a location below the upper opening toward a location above the secondary lower opening. The brush assembly may include at least one brush movable across the grate, and a carrier assembly configured to carry the at least one brush across substantially an entire top of the grate.

In another aspect, the disclosure relates to a material processing system that may comprise a roller-grinder apparatus having an intake opening, and a scalper apparatus configured to divide a flow of material between a filtered stream and an unfiltered stream. The scalper apparatus may have an inlet for receiving unprocessed material and an outlet for outputting processed material. The scalper apparatus may comprise a housing having an interior, and an upper opening defining the inlet of the scalper apparatus. The housing may have a primary lower opening for outputting the filtered stream of material, and a secondary lower opening for outputting the unfiltered stream of material. The primary lower opening may be in communication with the intake opening of the roller-grinder apparatus to provide the filtered stream of material to the roller-grinder apparatus. The housing may have opposite side walls and end walls defining the interior. The scalper apparatus may also comprise a grate extending across the interior of the housing between the side walls such that any material leaving the interior through the primary lower opening must pass through the grate while any material unable to pass through the grate is caused to move through the secondary lower opening. The grate may be substantially horizontally oriented with a slight slope with a portion of the grate located below the upper opening being relatively higher than a portion of the grate located above the secondary lower opening at an opposite end of the housing. The scalper apparatus may further comprise a brush assembly configured to move material entering the apparatus along the grate from a location below the upper opening toward a location above the secondary lower opening. The brush assembly may include a plurality of brushes movable across the grate and a carrier assembly configured to carry the plurality of brushes across substantially an entire top of the grate. The brushes may each have a length substantially equal to a width of the grate between opposite side walls of the housing such that substantially an entirety of the grate is swept by the at least one brush. The carrier assembly may include at least one chain loop with the plurality of brushes mounted on the at least one chain loop at spaced locations on the chain loop to move the plurality of brushes in a succession across the grate.

There has thus been outlined, rather broadly, some of the more important elements of the disclosure in order that the detailed description thereof that follows may be better understood, and in order that the present contribution to the art may be better appreciated. There are additional elements of the disclosure that will be described hereinafter and which will form the subject matter of the claims appended hereto.

In this respect, before explaining at least one embodiment or implementation in greater detail, it is to be understood that the scope of the disclosure is not limited in its application to the details of construction and to the arrangements of the components set forth in the following description or illustrated in the drawings. The disclosure is capable of other embodiments and implementations and is thus capable of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present disclosure. It is important, therefore, that the claims be regarded as including such equivalent constructions insofar as they do not depart from the spirit and scope of the present disclosure.

The advantages of the various embodiments of the present disclosure, along with the various features of novelty that characterize the disclosure, are disclosed in the following descriptive matter and accompanying drawings.

BRIEF DESCRIPTION OF THE DRAWINGS

The disclosure will be better understood and when consideration is given to the drawings and the detailed description which follows. Such description makes reference to the annexed drawings wherein.

DETAILED DESCRIPTION

Figure 1:
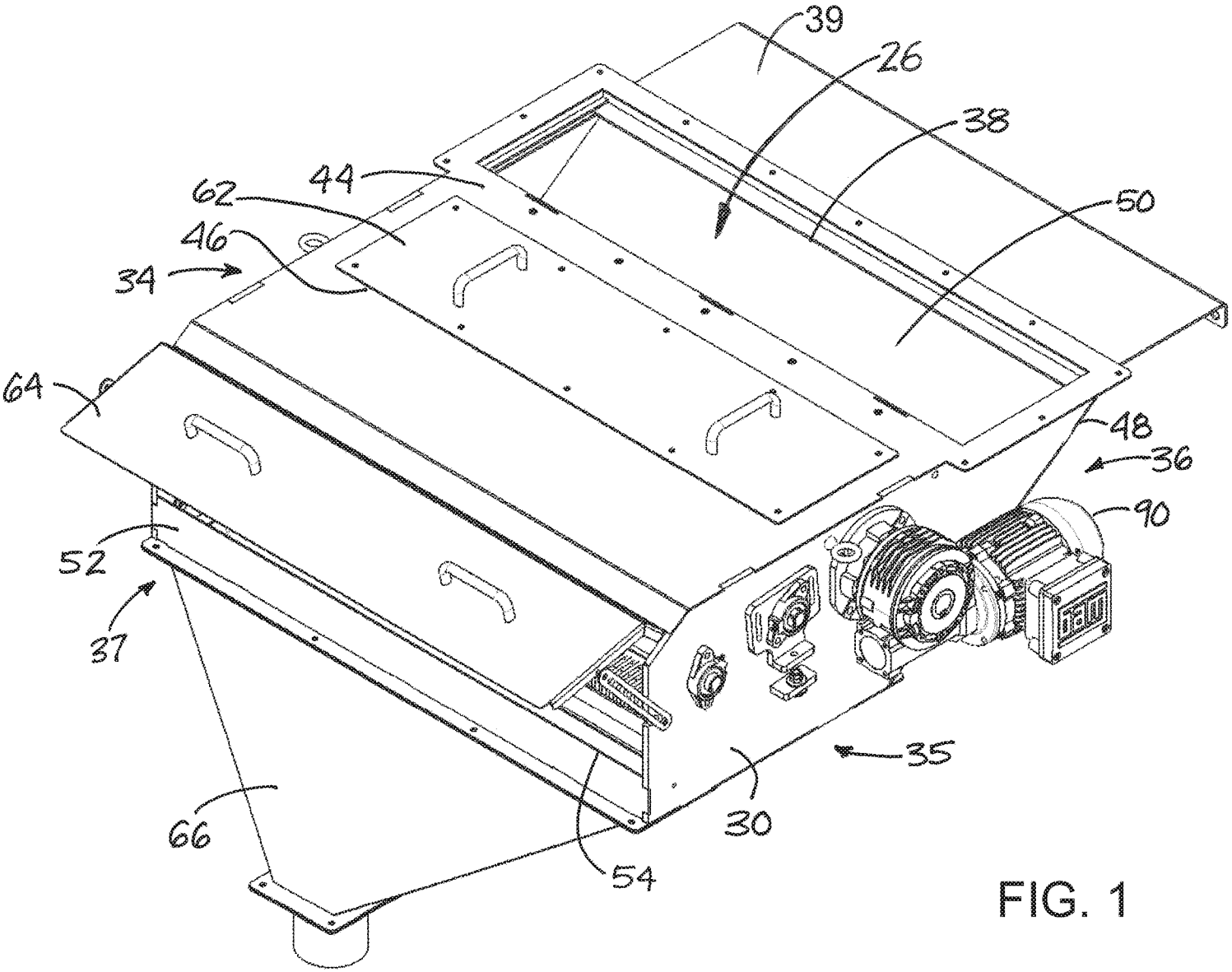
FIG. 1 is a schematic upper perspective view of a scalper of a new scalper apparatus and processing system according to the present disclosure.
Figure 2:
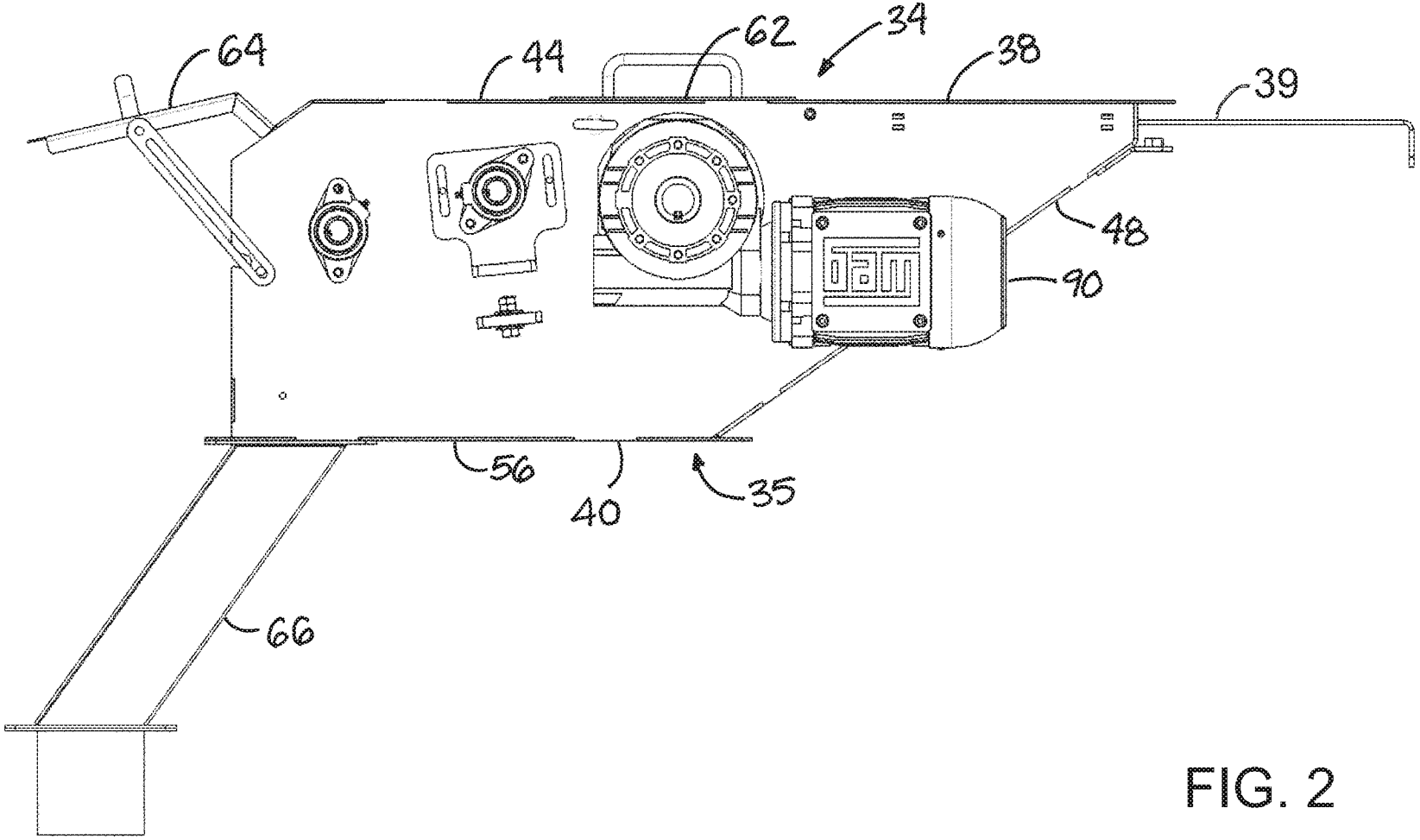
FIG. 2 is a schematic side view of the scalper, according to an illustrative embodiment.
Figure 3:
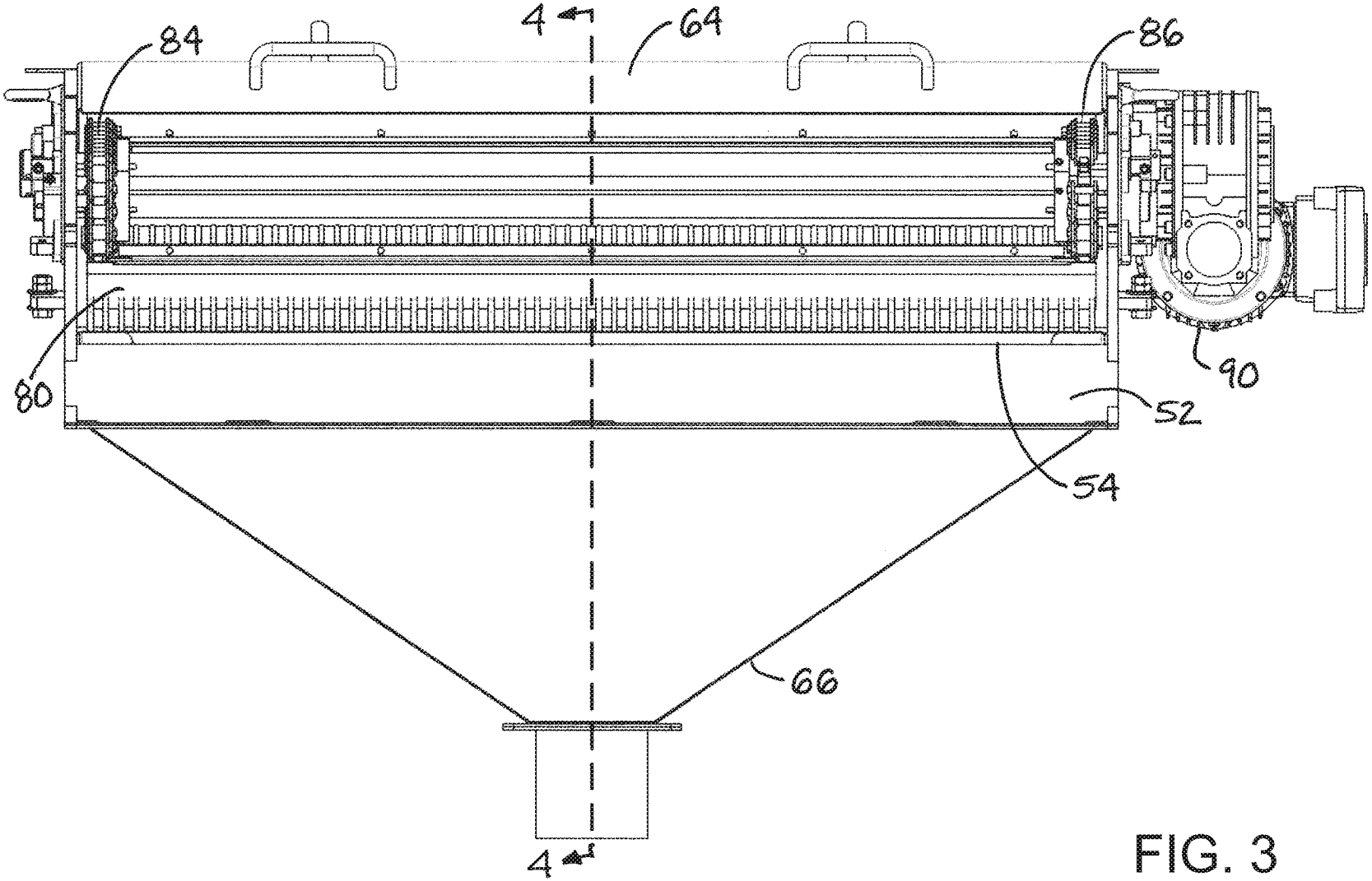
FIG. 3 is a schematic end view of the scalper, according to an illustrative embodiment.
Figure 4:
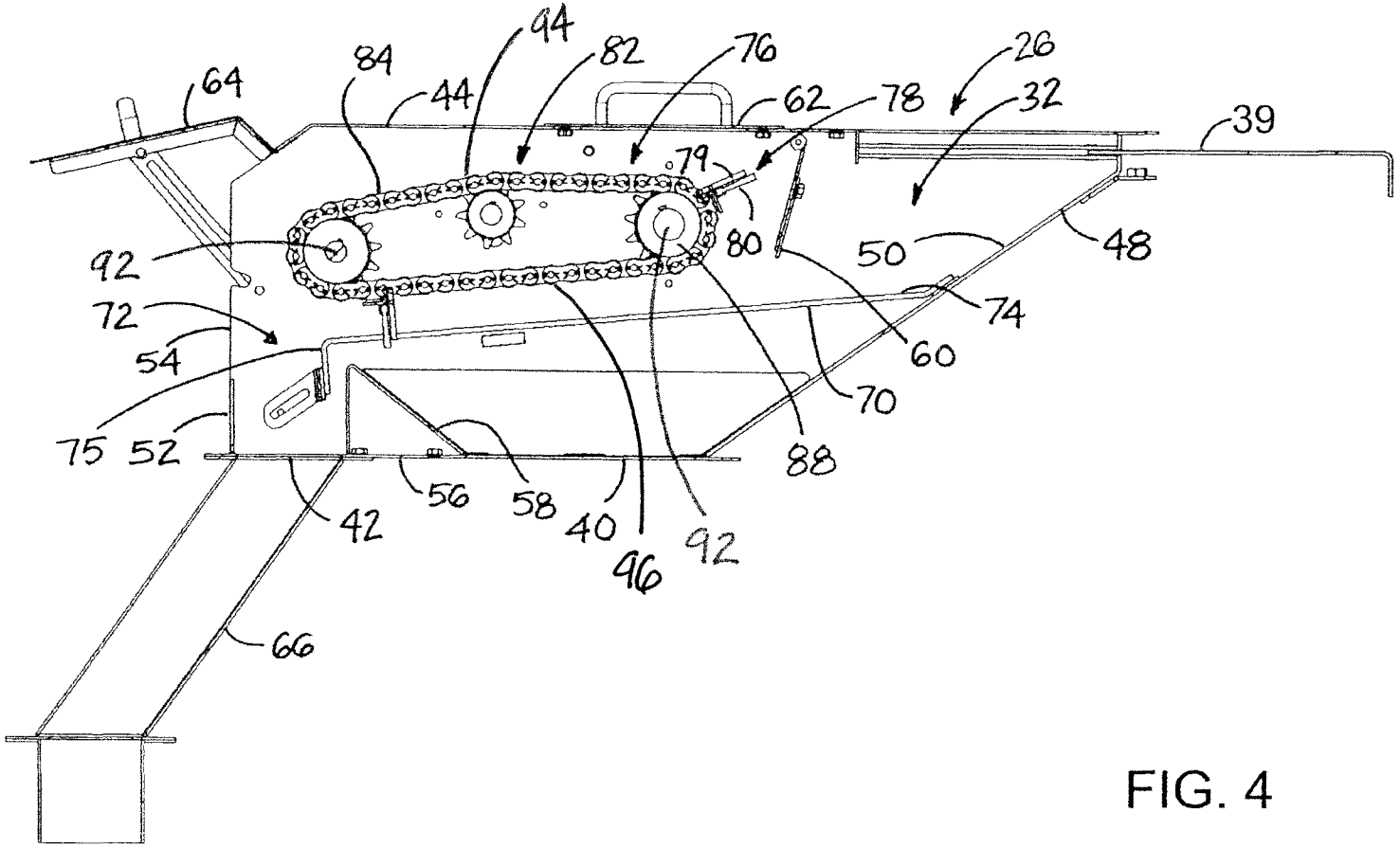
FIG. 4 is a schematic side sectional view of the scalper taken along line 4-4 of FIG. 3, according to an illustrative embodiment.
Figure 5:
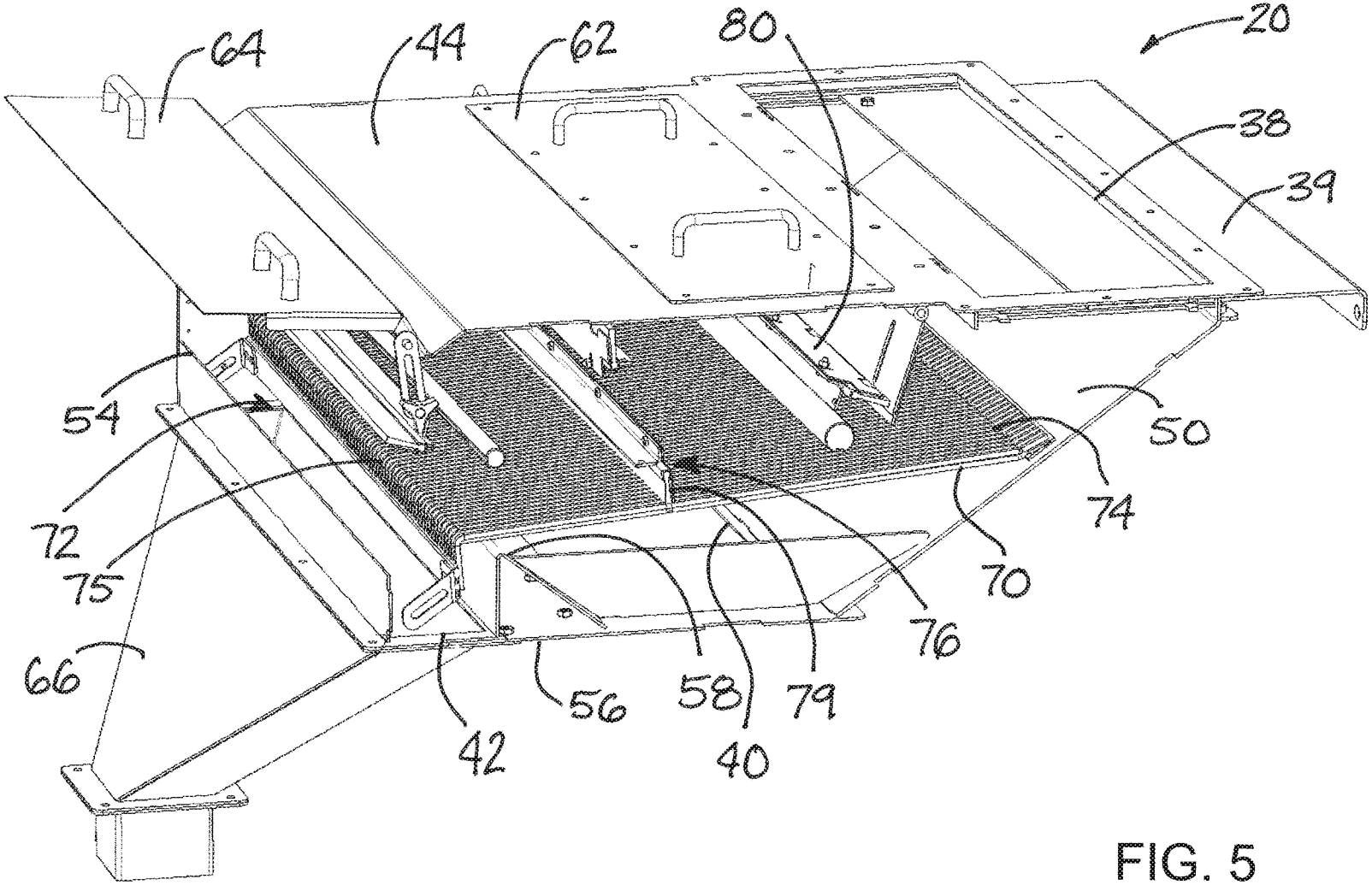
FIG. 5 is a schematic perspective side sectional view of the scalper taken along line 4-4 of FIG. 3, according to an illustrative embodiment.
Figure 6:
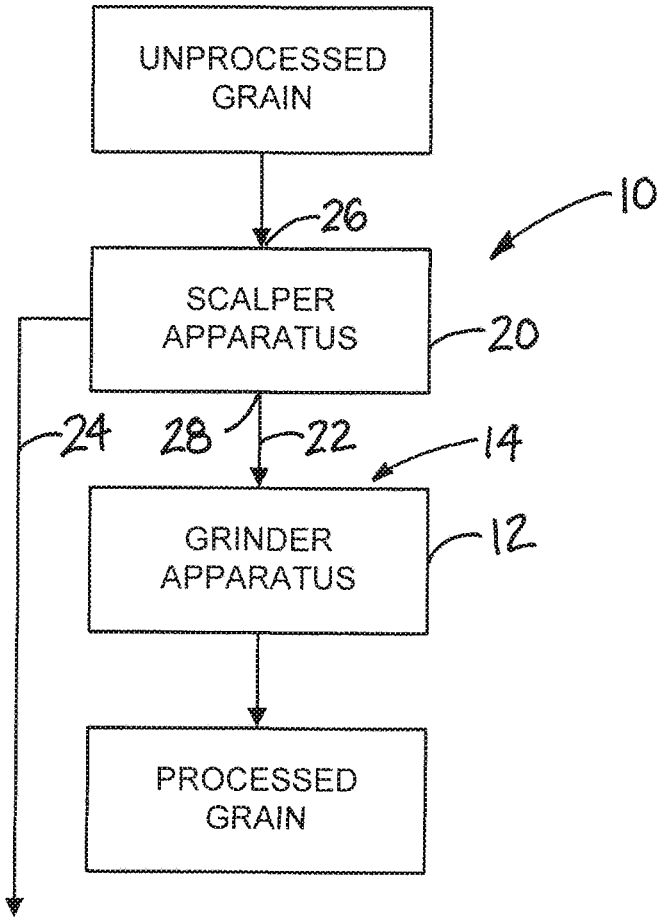
FIG. 6 is a schematic diagram of the system, according to an illustrative embodiment.

With reference now to the drawings, and in particular to FIGS. 1 through 6 thereof, a new scalper apparatus and processing system embodying the principles and concepts of the disclosed subject matter will be described.

While scalpers have been utilized for removing foreign material or debris from a stream of material, such as grain, prior to the material entering a processing apparatus such as a grinder, the applicants have recognized that problems tend to exist with the approaches taken in previous scalpers. Using gravity alone to passively clear the unfiltered debris from the filtering screen or grate often allows the foreign material to build up on the grate with no way of clearing the material from the grate, which then restricts the free flow of material through the grate and reduces the processing capacity of the apparatus. While other apparatus have utilized an active device to clear the grate of the unfiltered foreign material, the applicants have recognized the limitations of such apparatus since the devices have not been able to reach all portions of the entire surface of the grate and thus leave dead zones where foreign material may remain out of reach of the clearing device and thus continue to accumulate.

The applicants have developed a scalper apparatus with a device to make repeated sweeps of substantially the entire surface of the grate to clear the foreign material and debris with every pass of the device over the grate. The scalper apparatus may be integrated with or mounted in close association with a grinding apparatus such that the foreign material and debris is removed from the material flow in an immediate and compact manner with respect to the grinding apparatus.

In one aspect, the disclosure relates to a processing system 10 which may remove debris from the material flow prior to the grinding of the material. Illustratively, the material is a grain and the system will be described in the context of grain processing with the understanding that the applications of the disclosed system are not necessarily limited to the processing of grain. The system 10 may comprise a grinder apparatus 12 which may utilize rollers although other technologies for diminishing the size of the material may also be employed. The grinder apparatus 12 may have an intake opening which is typically located at the top 14 of the apparatus for receiving the grain that is to be processed, for example, into smaller or finer particle sizes.

The system 10 may also include a scalper apparatus 20 which is configured to remove foreign material and debris and other non-grain particles from the flow of grain prior to entering the grinder apparatus 12. The apparatus 20 may be configured to divide a flow of material such as grain between a filtered stream 22 and an unfiltered stream 24. The scalper apparatus 20 may have an inlet 26 for receiving unprocessed, unfiltered material including material both suitable and unsuitable for further processing beyond the apparatus 20. The scalper apparatus 20 may also have an outlet 28 for outputting separate streams including processed or filtered grain, such as in the filtered stream 22, and foreign material and debris, such as in the unfiltered stream 24.

The scalper apparatus 20 may be mounted on the grinder apparatus, and may be positioned at the top 14 of the grinder apparatus such that a vertical flow or movement of the grain encounters the scalper apparatus 20 before entering the grinder apparatus 12. The scalper apparatus may be positioned adjacent to the intake opening 12 of the grinder apparatus such that the grain passes first through the scalper apparatus and the material of the filtered stream 22 is directed into the intake opening of the roller grinder apparatus 12.

The scalper apparatus 20 may include a housing 30 having an interior 32 in which the grain is filtered. The housing 30 may have a top 34 and a bottom 35, as well as a first end 36 and a second end 37. The housing 30 may have an upper opening 38 defining the inlet 26 of the scalper apparatus and may be located at the top 34 of the housing. In some embodiments, the upper opening 38 may be located toward the first end 36 of the apparatus. A slide gate 39 may be movable across the upper opening 38 to selectively open and close the upper opening 28 to varying degrees to provide control of the flow of material into the upper opening. The housing may have a primary lower opening 40 through which the filtered stream 22 of material is output from the housing. The housing 30 may also include a secondary lower opening 42 through which is output the unfiltered stream 24 of material from the housing. In some embodiments, the primary lower opening 40 may be substantially centrally located on the housing between the first 36 and second 37 ends of the housing and the secondary lower opening may be located between the primary lower opening and the second end 37.

The housing may also include an upper wall 44 positioned at the top 34 of the housing and which may have the upper opening 38 located therein. The upper wall 44 may also have an upper access opening 46 to provide access to the interior 32 of the housing toward the top 34. The housing may also include a first end wall 48 positioned at the first end 36 of the housing, and the wall 48 may be positioned below the upper opening 38. The first end wall 48 may have an inner surface 50 which is sloped toward the second end 37 and may generally extend from the upper wall 44 to the primary lower opening 40. The housing may also include a second end wall 52 which is positioned at the second end 37 of the housing in opposition to the first end wall. In some embodiments, the second end wall 52 may have an end access opening 54 through which access to the interior 32 of the housing may be provided. The housing may also include a bottom wall 56 positioned below the upper wall 44 and which has the primary lower opening 40 and the secondary lower opening 42 located therein. An intermediate wall 58 of the housing may be positioned between the primary 40 and secondary 42 lower openings. The intermediate wall 58 may have a surface that is inclined or sloped toward the primary lower opening 40 such that it generally converges toward the first end wall. The housing may also include a shield 60 which extends downwardly proximate to the upper wall 44 and may be positioned adjacent to the upper opening 38. The shield 60 may be positioned between the upper opening 38 and the second end 37 of the housing and may tend to direct incoming material downwardly in a direction toward the primary lower opening.

The housing 30 may also include an upper access door 62 which is mounted on the upper wall and may be configured to selectively close the upper access opening 46. Illustratively, the upper access door 62 is pivotally or hingedly mounted on the upper wall and movable between closed and open conditions. The housing may also include an end access door 64 mounted on the second end wall 52 to selectively close the end access opening 54 in the second end wall. Illustratively, the end access door 64 may be pivotally mounted on the second end wall to move between open and closed positions. The housing may also include a chute 66 which is in communication with the secondary lower opening 42 and may extend downwardly from the opening 42 to guide debris and other materials of the unfiltered stream 24 to a suitable receptacle for disposal.

The scalper apparatus 20 may also include a grate 70 to filter the material entering the housing and separating the material between the filtered and unfiltered streams. The grate may have openings through which material may pass of a size smaller than a desired maximum size or characteristic of a particular type of material, such as a grain kernel. The openings in the grate may be holes or apertures, but in some highly suitable embodiments the openings are elongated openings or slots that generally extend longitudinally between the first and second end walls of the housing. The grate 70 may extend across at least a portion of the interior 32 of the housing. The grate 70 may have a width and a length between opposite ends 74, 75 of the grate, and the width and length may be such that the grate extends to the walls of the housing to create a barrier and material must pass through the grate to reach the primary lower opening, or travel across the top of the grate to reach the secondary lower opening. A gap 72 may be formed between the second end 75 of the grate 70 and the second end wall 52 to permit material of the unfiltered stream 24 to pass between the grate and the end wall 52 and move down through the secondary lower opening 42. The grate may be substantially horizontally oriented in the interior with a slight slope such that a portion of the grate located toward the first end wall (and below the upper opening 38) may be relatively higher than a portion of the grate located toward the second end wall (and above the secondary lower opening 42). The grate 70 may extend substantially completely across the interior 32 of the housing, and may be located above the primary lower opening 40 such that material leaving the interior of the housing through the primary lower opening 40 must pass through the grate while any material unable to pass through the grate is caused to move through the secondary lower opening 42.

The scalper apparatus 20 may also include a brush assembly 76 which is configured to urge or move material entering the scalper apparatus along the top of the grate 70 from a location below the upper opening 38 toward the second end 75 of the grate, and a location above the secondary lower opening 42 and the gap 72 between the grate and the second end wall 52. As material enters through the upper opening 38 and rests upon the grate 70, the brush assembly 76 may cause the material to move across the grate 70 with particles smaller than the size of the openings in the grate falling through the grate and into the primary lower opening while particles with a size larger than the openings in the grate tend to move across the top of the grate as urged or pushed by the brush assembly toward the end 75 of the grate and into the gap 72 between the grate and the second end wall.

The brush assembly may include at least one brush 78 which is movable across the grate in a direction that is substantially parallel to the length of the grate between the ends 74, 75 of the grate. The brush 78 may extend across the grate preferably to a degree that the brush 78 extends substantially entirely across the width of the grate. The brush may have a length which is substantially equal to the width of the grate to accomplish this. The brush 78 may have a plurality of bristles 79, and the brush may have a relatively thin thickness dimension in which the thickness dimension is oriented in a direction parallel to the length of the grate and the direction of movement of the brush across the grate. The portion of the grate 70 that is swept by the brush assembly 76 may extend from the end 75 of the grate located adjacent to the gap above the secondary lower opening 42 back towards the area beneath the upper opening 38. The brush 78 may include a paddle 80 that is positioned adjacent to the bristles and relatively behind with respect to the movement direction of the brush. The paddles 80 may have a flexible character but may also provide sufficient resistance to bending to provide the bristles with a degree of resistance to bending. The paddle may also extend for substantially the entire length of the brush 78.

The brush assembly 76 may include a plurality of the brushes 78 which are movable across the grate serially in spaced relationship to each other such that one or more of the brushes may be in contact with the grate at any one time. Illustratively, the brush assembly may be configured so that as one brush is lifted from contact with the grate, another brush is brought into contact with the grate, although other arrangements may be utilized. The brush assembly 76 may also include a carrier assembly 82 which is configured to carry the brush or brushes 78 across the grate. The carrier assembly 82 may be located in the interior 32 of the housing, and may include at least one chain loop 84, and preferably a pair of chain loops 84, 86 which extend over the grate in a longitudinal direction of the grate. The chain loops may each have an upper extent 94 carrying at least one of the brushes and a lower extent 96 also carrying at least one of the brushes. The lower extent 96 of each chain loop may be oriented to slope downwardly toward the second end 75 of the grate (and upwardly toward the first end 74 of the grate) to move the material downwardly along the grate toward the second end. The chain loops 84, 86 may be positioned substantially parallel to each other with the brush or brushes being attached to the chains in a configuration that bridges between the chains. The brushes may be attached to the chain loops at spaced locations on the chain loops, and the chain loops may be supported on sprockets 88 rotatably mounted in the housing at locations such that the brushes are alternately moved or drug across the top of the grate and then lifted from the grate and inverted to be taken back towards an opposite end of the grate to reengage the grate. The sprockets 88 carrying the chain may be mounted on support shafts 90, and at least one of the support shafts carrying a sprocket may be rotated by a motor 92 mounted on the housing, and which may be located on an exterior of the housing. A gearbox may be provided to provide a suitable speed of movement of the brushes over the grate by the motor.

It should be appreciated that in the foregoing description and appended claims, that the terms "substantially" and "approximately," when used to modify another term, mean "for the most part" or "being largely but not wholly or completely that which is specified" by the modified term.

It should also be appreciated from the foregoing description that, except when mutually exclusive, the features of the various embodiments described herein may be combined with features of other embodiments as desired while remaining within the intended scope of the disclosure.

Further, those skilled in the art will appreciate that the steps disclosed in the text and/or the drawing figures may be altered in a variety of ways. For example, the order of the steps may be rearranged, substeps may be performed in parallel, shown steps may be omitted, or other steps may be included, etc.

With respect to the above description then, it is to be realized that the optimum dimensional relationships for the parts of the disclosed embodiments and implementations, to include variations in size, materials, shape, form, function and manner of operation, assembly and use, are deemed readily apparent and obvious to one skilled in the art in light of the foregoing disclosure, and all equivalent relationships to those illustrated in the drawings and described in the specification are intended to be encompassed by the present disclosure.

Therefore, the foregoing is considered as illustrative only of the principles of the disclosure. Further, since numerous modifications and changes will readily occur to those skilled in the art, it is not desired to limit the disclosed subject matter to the exact construction and operation shown and described, and accordingly, all suitable modifications and equivalents may be resorted to that fall within the scope of the claims.

I claim:

1. A material processing system comprising:

a roller-grinder apparatus having an intake opening; and a scalper apparatus configured to divide a flow of material between a filtered stream and an unfiltered stream, the scalper apparatus having an inlet for receiving unprocessed material and an outlet for outputting processed material, the scalper apparatus comprising:

a housing having an interior, the housing including an upper opening defining the inlet of the scalper apparatus, a primary lower opening for outputting the filtered stream of material, and a secondary lower opening for outputting the unfiltered stream of material, the primary lower opening being in communication with the intake opening of the roller-grinder apparatus to provide the filtered stream of material to the roller-grinder apparatus, the housing having opposite sides with side walls and opposite ends with end walls defining the interior, an upper wall positioned at a top of the housing, the upper wall having the upper opening therein, the upper wall having an upper access opening in addition to the upper opening;

a first one of the end walls being positioned at a first one of the ends of the housing below the upper opening, the first end wall having an inner surface sloped toward a second one of the ends of the housing, the first end wall extending from the upper wall to the primary lower opening;

a second one of the end walls being positioned at the second one of the ends of the housing, the second end wall having an end access opening;

a shield extending downwardly from the upper wall in the interior of the housing at a position adjacent to the upper opening;

an upper access door mounted on the upper wall and being configured to selectively close the upper access opening;

an end access door mounted on the second end wall and being configured to selectively close the end access opening;

a grate having a first end and a second end opposite of the first end, the grate extending across the interior of the housing between the side walls such that any material entering the interior through the upper opening of the housing falls onto and rests upon a top of the grate toward the first end of the grate, the grate having openings elongated in a first direction substantially parallel to an axis extending between the first and second ends of the grate such that any material leaving the interior through the primary lower opening must pass through the elongated openings of the grate while any material unable to pass through the grate is caused to move through the secondary lower opening, the grate being substantially horizontally oriented with a slope such that the first end is higher than the second end of the grate, a portion of the grate toward the first end being located below the upper opening and a portion of the grate toward the second end being located above the secondary lower opening, a gap is formed between the second end of the grate and an inner surface of the housing such that material unable to pass through the grate falls from the top of the grate through the gap and into the secondary lower opening; and a pusher assembly positioned in the interior of the housing, the pusher assembly including:

a plurality of pushers configured to contact the top of the grate to engage material which has entered the scalper apparatus and rests on the top of the grate, the pushers each being elongated in a second direction oriented substantially perpendicular to the first direction of the grate; and a carrier assembly configured to move the plurality of pushers across the grate in the first direction to thereby actively push material resting on the top of the grate along the grate in a direction substantially parallel to the elongation of the openings in the grate;

wherein the pusher assembly moves the material from a location below the upper opening toward a location above the secondary lower opening such that any material unable to pass through the grate falls from the top of the grate at the second end of the grate to move through the secondary lower opening, the pushers each having a length substantially equal to a width of the grate between opposite side walls of the housing such that substantially an entirety of the width of the grate is swept by at least one pusher of the plurality of pushers;

wherein the carrier assembly comprises a pair of loops spaced from each other in the first direction, the plurality of pushers being mounted on the pair of loops to move the plurality of pushers in a succession across the grate;

wherein the pair of loops of the carrier assembly has an upper extent carrying at least one of the pushers and a lower extent carrying at least one of the pushers, the lower extent of each of the loops being oriented to slope downwardly toward the second end of the grate to move material downwardly along the grate toward the second end; and wherein the plurality of pushers are mounted on the pair of loops of the carrier assembly at locations on the loops spaced from each other in the second direction such that gaps are formed between the pushers mounted on the carrier assembly and between the pair of spaced loops spaced in the first direction to permit material to pass through the carrier assembly between the pushers;

wherein the pair of loops comprises a pair of chain loops with each chain loop being entrained on a pair of sprockets spaced from each other in the first direction of the grate;

wherein the shield of the housing is positioned between the upper opening and the pusher assembly to shield the pusher assembly from material entering the upper opening; and wherein the upper access opening and the end access opening are located adjacent to the pusher assembly to provide access to the pusher assembly located in the interior of the housing.

* * * * *